US007065791B1

(12) United States Patent
Harris et al.

(10) Patent No.: US 7,065,791 B1
(45) Date of Patent: Jun. 27, 2006

(54) APPARATUS FOR A SALON CAPE WATER GUARD

(76) Inventors: Aaron D. Harris, 104 Grinders Mill Rd., Columbia, SC (US) 29233; Lillie R. Harris, 104 Grinders Mill Rd., Columbia, SC (US) 29233

( * ) Notice: Subject to any disclaimer, the term of this patent is extended or adjusted under 35 U.S.C. 154(b) by 0 days.

(21) Appl. No.: 11/074,969

(22) Filed: Mar. 9, 2005

(51) Int. Cl.
*A41D 13/00* (2006.01)

(52) U.S. Cl. ..... 2/50; 2/60

(58) Field of Classification Search ..... 2/48, 2/50, 51, 52, 49.1, 49.2, 46, 468, 60, 53, 2/55, 80, 94, 49.3–49.5, 102, 104, 207, 267; D2/860–864
See application file for complete search history.

(56) References Cited

U.S. PATENT DOCUMENTS 2,416,609 A * 2/1947 Brehm ..... 2/50
2,482,182 A * 9/1949 Henninnger ..... 2/48
2,654,092 A 10/1953 Brennisn
2,674,739 A * 4/1954 Barnett ..... 2/50
2,793,367 A * 5/1957 Hart ..... 2/48
2,794,985 A 6/1957 Brennisn
2,831,193 A * 4/1958 Terry ..... 2/46
2,947,004 A 9/1960 Pfile
4,050,099 A * 9/1977 David ..... 2/46
D270,320 S 8/1983 Smith
4,458,364 A * 7/1984 Fenninger et al. ..... 2/50
5,572,740 A 11/1996 Geniesse
5,640,715 A * 6/1997 Adams ..... 2/46
D382,091 S * 8/1997 Leahy ..... D2/823
5,950,236 A * 9/1999 Andrew et al. ..... 2/50
5,960,471 A * 10/1999 Burton ..... 2/48
5,991,919 A 11/1999 Baggetto
6,094,744 A * 8/2000 Dibenedetto et al. ..... 2/50

* cited by examiner

*Primary Examiner*—Amy B. Vanatta

(57) ABSTRACT

A salon cape water guard with two pockets and could hang on the neckline of a salon cape and catch water with a towel that could be inserted into one or both pockets. The water guard is made from any material that absorbs or resists water. Therefore, it protects the customer's clothing and back from getting wet.

1 Claim, 4 Drawing Sheets

APPARATUS FOR A SALON CAPE WATER GUARD

BACKGROUND

1. Field

The present disclosure pertains to a Salon Cape Water Guard.

2. Description of Related Art

Salon Capes are a necessary and common item found in practically every salon or beauty school and can even be found in the household. They are typically used for keeping both water and hair from getting on the customer's clothing. Unfortunately they do not always work as planned. Water often manages to leak through the neckline causing discomfort to the customer and sometimes the customer is forced to continue the rest of the day with a soaked collar and back.

BRIEF DESCRIPTION OF THE FIGURES

The present invention is illustrated by way of example and not limited in the Figures of the accompanying drawings.

DETAILED DESCRIPTION

The following description provides an apparatus for a Salon Cape Water Guard. In the following description, numerous specific details are set forth in order to provide a more thorough understanding of the present invention. It will be appreciated, however, by one skilled in the art that the invention may be practiced without such specific details.

As previously described, various problems exist for presently existing salon capes. For example, at times, the neckline can leak water and this can be uncomfortable for the customer wearing it because their neck and clothing can get wet and cold. However, if the salon cape water guard is used in conjunction with the salon cape, water leakage can be prevented. The water guard can be inserted at the back of the salon cape and could catch the water before it has a chance to leak into the salon cape.

Figure 1:
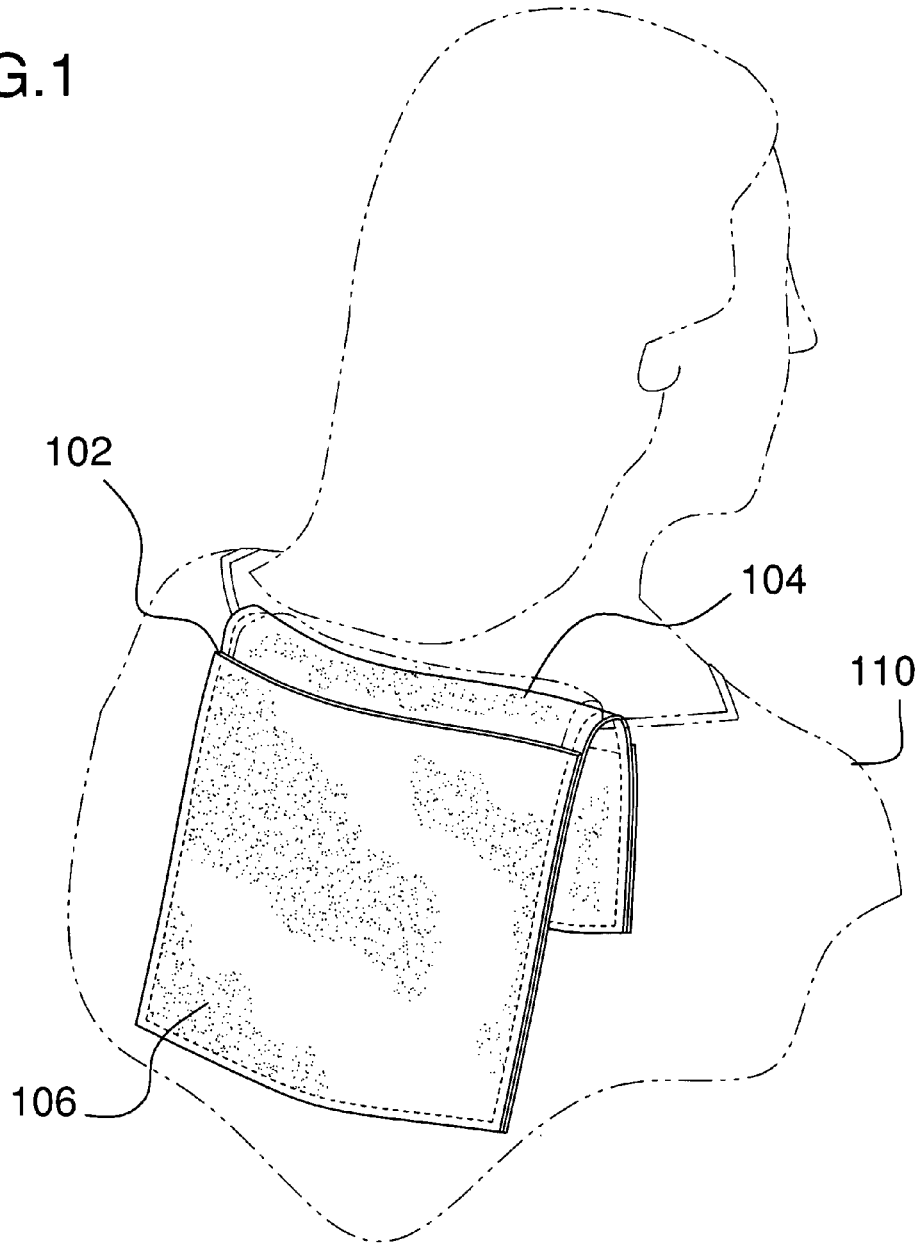
FIG. 1 illustrates a frontal isometric view of one embodiment of the water guard as used with a salon cape that a customer is wearing.

FIG. 1 illustrates a view of the design that shows how the design could be used with a salon cape 110 that a customer is wearing. The design can be flat and rectangular in shape and can be made of a material 106 that is water resistant, such as nylon. In one embodiment, the design is about 19½ inches long and 14 inches wide and has one pocket 102 on each side. In one embodiment, each pocket has one opening, the openings face each other and the pockets are a few inches from each other. In one embodiment, the pockets are different sizes, with one pocket taking up about ¼ of the area of the rectangle shaped design on one side of the rectangle and the other pocket taking up a little over ½ of the space of the rectangle shaped design on the other half of the rectangle. The pockets 102 can be designed to open enough to hold a towel 104 inside the pockets that would fill both pockets and cover almost the entire area of the rectangle. When the towel is inside both pockets, a few inches of towel can be viewed between the pockets because of the space between the pockets. When used with a salon cape, the towel would be inside the pockets and the design would be inserted into the back of the salon cape with the pockets facing up. In one embodiment, the smaller pocket would hang on the inside of the salon cape and the larger pocket would hang on the outside of the salon cape. The space between the pockets, where the towel shows, could rest on the neckline of the cape. The water that drips off of the hair and from the spray nozzle would drip onto the towel and then collect into the pockets instead of dripping down the back of the customer through the neckline of the salon cape.

Figure 2:
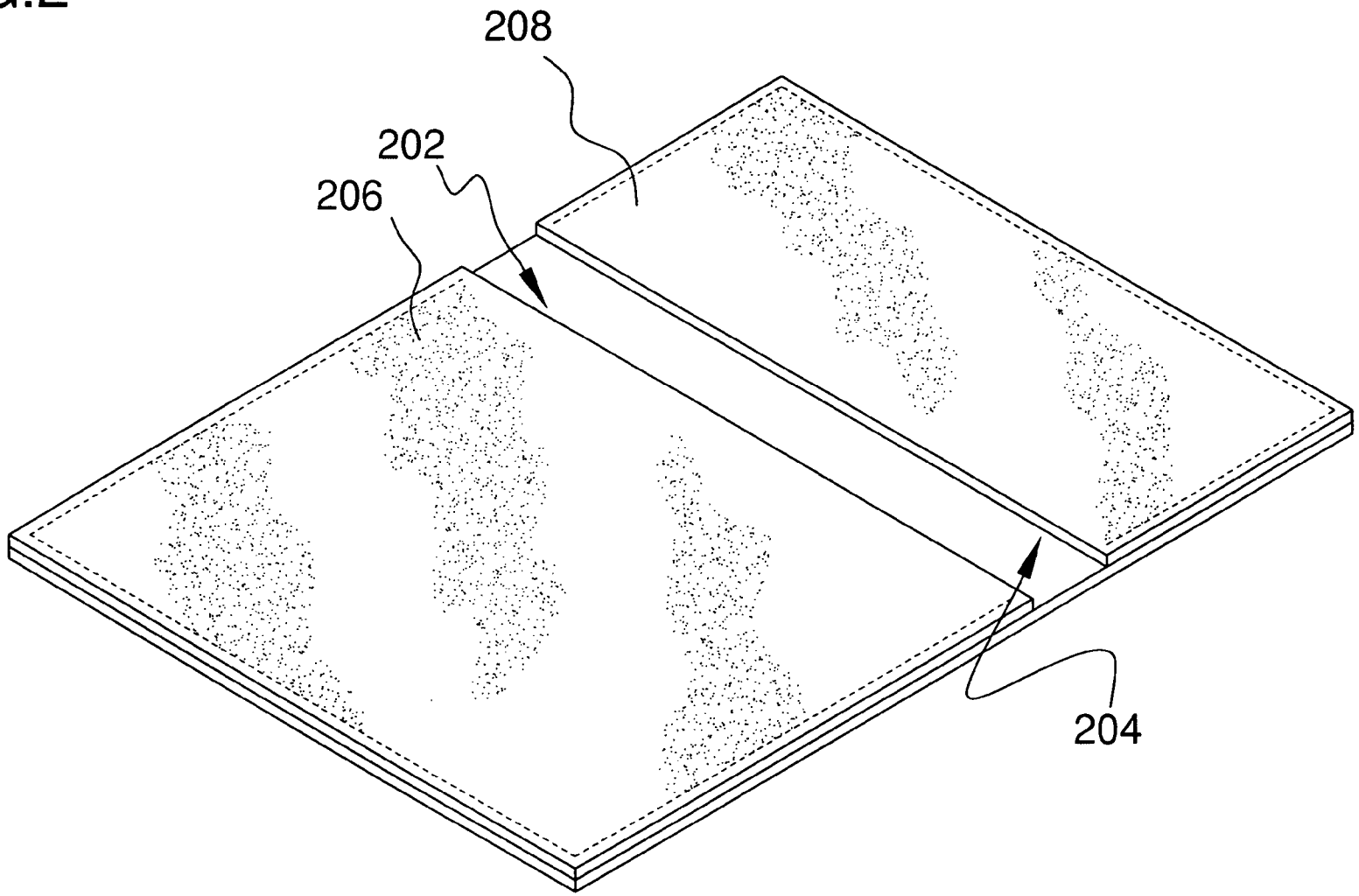
FIG. 2 illustrates a frontal isometric view of one embodiment of the water guard.

FIG. 2 illustrates a top view of the design. The design appears to be laying flat without a towel inside of it. In one embodiment, each pocket is stitched on three sides and the stitching is on the very edge of the rectangle shaped body of the design, leaving openings 202, 204 on the fourth sides. The pockets 206,208 face each other in accordance with FIG. 1 and the pockets take up the entire area of the rectangle shaped body, except for the space that is between the pockets. In one embodiment, the design is comprised of two layers of fabric, the bottom, and the pockets. In one embodiment, the space between the pockets is one layer thick.

Figure 3:
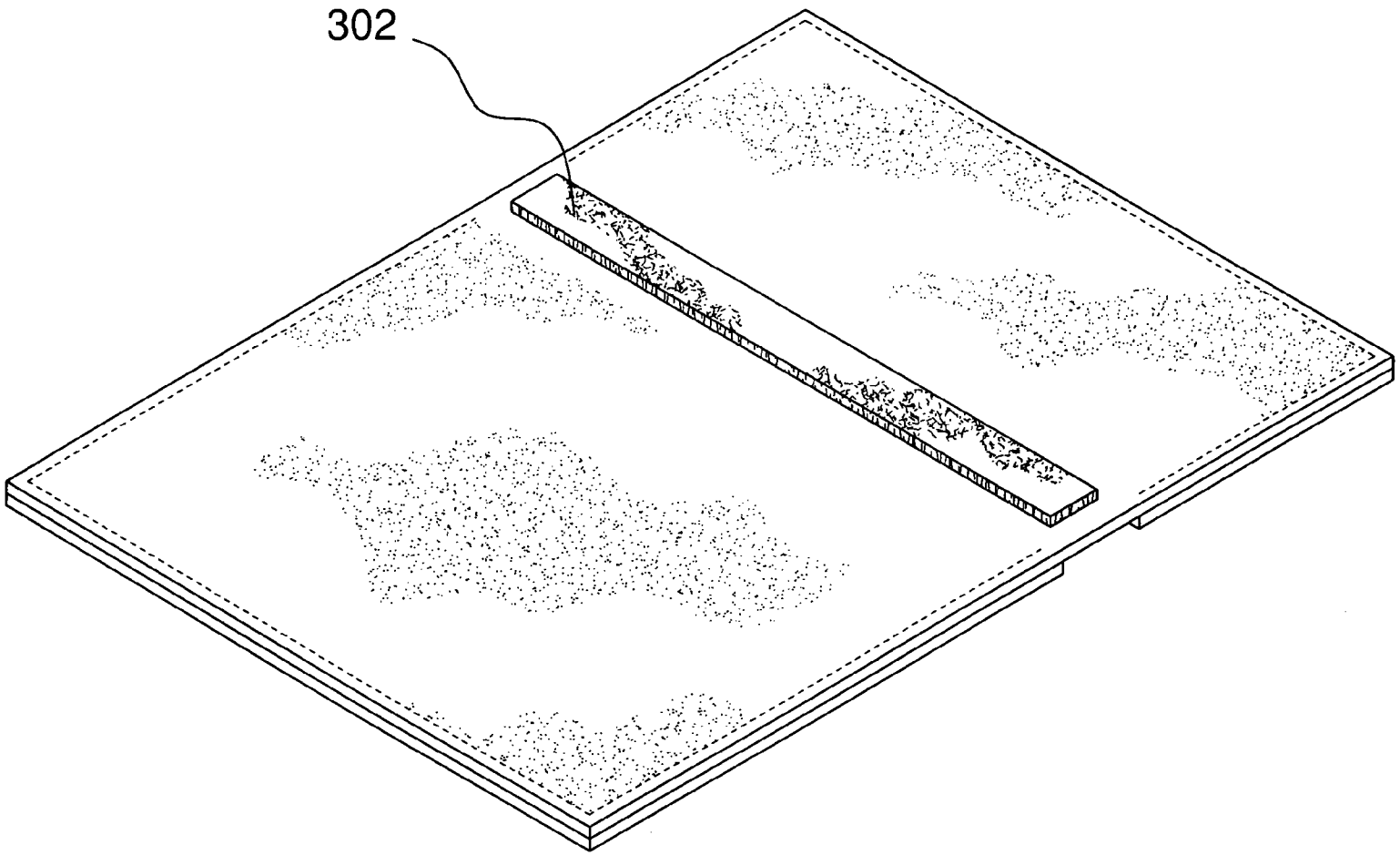
FIG. 3 illustrates a rear isometric view of one embodiment of the water guard.

FIG. 3 illustrates a bottom view of the design. The design is shown to be rectangle in shape in accordance with FIGS. 1 and 2. There could be a Hook and Loop strip 302 on the bottom that can, in one embodiment, measure the entire width of the design and be a few inches in length and could be located in the space between the pockets on the bottom of the design. This strip could allow the design to attach to a salon cape which has a mating hook and loop strip thereon.

Figure 4:
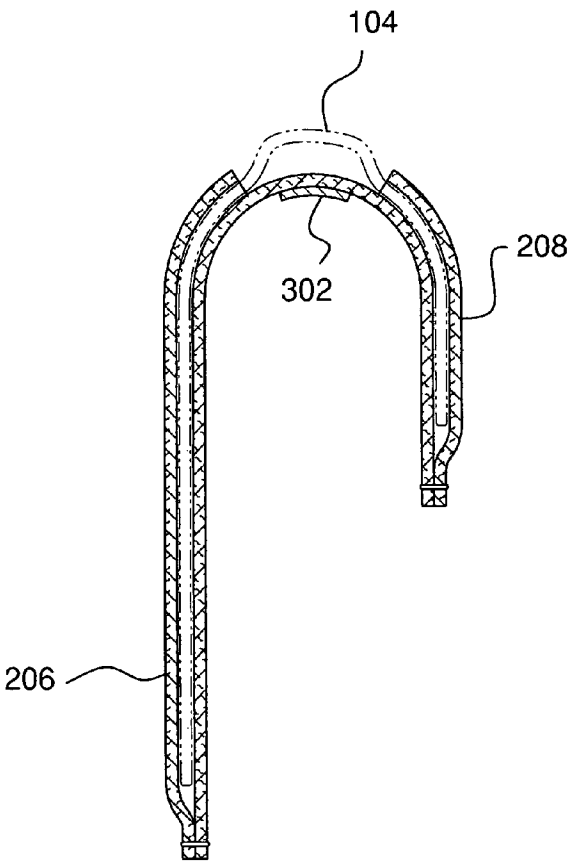
FIG. 4 illustrates a cross sectional view of one embodiment of the water guard as used with a salon cape that a customer is wearing.

FIG. 4 illustrates a side cross-section view of the design. It is shown with a towel 104 inside of the pockets 206,208. The pockets are shown stitched on three sides in accordance with FIG. 2. The Hook and Loop strip is shown attached to the bottom of the design directly underneath the spot that is on the top of the design where there is space between the pockets and where the towel is visible, in accordance with FIG. 3. The Figure also shows the inside of the pockets and shows the towel filling up the entire area of the pockets except for a small amount of space on each end of the pockets. The Figure shows the design and how it would look, as if it were hanging over the edge of the neckline of a salon cape. Each pocket could hang downward and the spot between the pockets where the towel is visible could be at the highest point.

What is claimed is:

1. An inverted j-shaped water guard for a salon cape comprising:

a top side of the water guard with a first and second pocket, a space between an opening of the first and second pocket to allow insertion of a towel such that a first portion of the towel rests in the first pocket and a second portion of the towel rests in the second pocket and a third portion of the towel rests on the space between the opening of the first and second pocket, wherein the first pocket is larger than the second pocket, and the second pocket is larger than the space between the openings of the first and second pocket, wherein the water guard resembles an upside down j;

a back side of the space of the water guard having a hook and loop strip thereon to secure the water guard to the salon cape via a mating hook and loop strip on the salon cape; and the first and second pocket to hang downward upon insertion of the towel.

* * * * *